US008230997B1

(12) United States Patent
McWilliams et al.

(10) Patent No.: US 8,230,997 B1
(45) Date of Patent: Jul. 31, 2012

(54) BOTTLE SUPPORT FOR PACKAGING AND SHIPPING

(76) Inventors: Glenn P. McWilliams, Carmichael, CA (US); Richard A. Hall, Sacramento, CA (US)

( * ) Notice: Subject to any disclaimer, the term of this patent is extended or adjusted under 35 U.S.C. 154(b) by 166 days.

(21) Appl. No.: 12/290,164

(22) Filed: Oct. 27, 2008

Related U.S. Application Data

(60) Provisional application No. 61/001,653, filed on Nov. 2, 2007, provisional application No. 61/063,615, filed on Feb. 1, 2008, provisional application No. 61/125,105, filed on Apr. 21, 2008.

(51) Int. Cl.
*B65D 71/00* (2006.01)
*B65D 65/00* (2006.01)

(52) U.S. Cl. ..... 206/433; 206/588; 206/139; 206/427

(58) Field of Classification Search ..... 206/139, 206/588, 591, 593, 521.9, 583, 594, 427, 206/433
See application file for complete search history.

(56) References Cited

U.S. PATENT DOCUMENTS

| | | | | | |
|---|---|---|---|---|---|
| 2,325,224 | A | * | 7/1943 | Bryant | 206/446 |
| 2,422,152 | A | * | 6/1947 | Vatter | 206/418 |
| 2,517,767 | A | * | 8/1950 | Cody | 229/120.23 |
| 3,631,970 | A | * | 1/1972 | Trauschke | 206/779 |
| 3,868,140 | A | * | 2/1975 | Gordon | 294/87.2 |
| 4,341,308 | A | | 7/1982 | Pasquini | |
| 4,869,599 | A | * | 9/1989 | Allen | 383/38 |
| 4,911,300 | A | * | 3/1990 | Colonna | 206/427 |
| 5,335,770 | A | | 8/1994 | Baker | |
| 5,487,463 | A | * | 1/1996 | Harris | 206/145 |
| 5,590,786 | A | * | 1/1997 | Jaycox | 206/587 |
| 5,624,032 | A | * | 4/1997 | Yucknut et al. | 206/433 |
| 5,730,289 | A | | 3/1998 | Cappels | |
| 5,806,683 | A | | 9/1998 | Gale | |
| 5,816,409 | A | | 10/1998 | Baker | |
| 5,950,829 | A | | 9/1999 | Gale | |
| 5,967,320 | A | | 10/1999 | Cappels | |
| 6,702,115 | B1 | * | 3/2004 | Roper | 206/427 |
| 6,820,743 | B2 | | 11/2004 | Hurley | |
| 7,121,408 | B2 | | 10/2006 | Wilson | |
| 7,237,675 | B2 | | 7/2007 | O'Malley | |
| 2006/0231441 | A1 | | 10/2006 | Gomes | |
| 2007/0138047 | A1 | | 6/2007 | Berglin | |
| 2008/0116085 | A1 | | 5/2008 | Artis | |
| 2008/0197037 | A1 | | 8/2008 | O'Brien | |
| 2009/0008436 | A1 | | 1/2009 | Edmondson | |

* cited by examiner

*Primary Examiner* — J. Gregory Pickett
*Assistant Examiner* — Ernesto Grano
(74) *Attorney, Agent, or Firm* — Heisler & Associates

(57) ABSTRACT

A bottle support is shown in the form of a double bottle enclosure, a single bottle enclosure and a triple bottle enclosure. Each enclosure embodiment includes an outer box having an orthorhombic shape. A lower retainer fits within a lower portion of the outer box. The lower retainer includes a top deck with holes therein to receive lower ends of bottles spaced from walls of the outer box. An upper retainer also fits within the outer box near an upper end of the outer box. The upper retainer includes a main panel with holes therein which are sized to receive necks of bottles passing therethrough. The main panel keeps the necks of the bottles from impacting the upper end of the box and centered within the outer box. The retainers are preferably formed of planar panels of rigid material, such as corrugated paperboard, cut and folded to form the retainers.

31 Claims, 6 Drawing Sheets

30
46
48
47
42
43
45
44
N
B
E
10

36
35
33
34
31
37
39
38
32
26
28
24
22
20

22
28
20
24
B
N
S
40
E
30
10

BOTTLE SUPPORT FOR PACKAGING AND SHIPPING

CROSS-REFERENCE TO RELATED APPLICATIONS

This application claims benefit under Title 35, United States Code §119(e) of U.S. Provisional Application No. 61/001,653 filed on Nov. 2, 2007; U.S. Provisional Application No. 61/063,615 filed on Feb. 1, 2008; and U.S. Provisional Application No. 61/125,105 filed on Apr. 21, 2008.

FIELD OF THE INVENTION

The following invention relates to corrugated paperboard boxes and packaging formed of corrugated paperboard and other similar planar panel-formed packaging material. More particularly, this invention relates to such packaging particularly configured for safely containing bottles with sufficient protection for the contained bottles to facilitate shipping without damage to the bottles contained therein.

BACKGROUND OF THE INVENTION

Historically, bottles and containers have been shipped in many styles and shapes of inner packaging using many different kinds of materials. The goal of these packages, was and is, to protect bottles and containers during rigorous parcel shipping conditions such as the Post Office, UPS, Fed Ex, etc. So far, only a few of those packages have been successful in their structural protection of the shipped product, as well as satisfying additional areas such as ease of assembly and packaging as well as cost effectiveness to purchase and minimizing environmental impacts.

For years there have been ongoing design efforts to develop the "perfect package," but there has not been much success and the packaging companies' design departments' struggle along every day with little or no success. There are products on the market today that really do not live up to the needed requirements for safely shipping bottles and containers as well as satisfying the other considerations.

Such prior art bottle packaging is generally included in an exterior corrugated paperboard box having a generally orthorhombic shape. The bottles are kept centered within the outer corrugated paperboard box through the utilization of expanded polystyrene foam. Other inserts which have been utilized include pressed or molded pulp inserts which are formed by taking a pulp-type product and through a molding process molding a structure having the desired contour to space the bottles away from the exterior box.

Such prior art packaging, while typically generally effective for protecting the bottles contained within the package, suffer from numerous drawbacks. For instance, expanded polystyrene foam is not readily recyclable and such molded bottle protecting inserts tend to take up a large amount of space and to be expensive to manufacture. Other alternative solutions include utilizing the outer box with sufficient interior packaging media (e.g. foam pellets, wadded up newspaper, etc.) to protect the bottles. Shipping companies have an affinity for standardized packaging which allows for the possibility of ensuring the safe delivery of goods without concern for the effectiveness of the packing which has occurred. When bottles are packed within an outer box in a manner that is not highly standardized, the shipping company cannot determine whether mishandling during transport or inadequate packing has led to any claims of damage. By standardizing the packaging and designing the standardized packaging to meet the requirements of the shipping companies, claims of damage can be properly made to the truly responsible parties.

SUMMARY OF THE INVENTION

With this invention a bottle support package is provided which includes an outer box and inserts to protect and hold at least one bottle within the outer box. The interior inserts include an upper retainer and a lower retainer to support upper and lower portions of the bottle. The lower retainer primarily includes a top deck, typically formed of planar corrugated paperboard material held up off of a lower end of the box. A hole in this top deck receives a lower end of the bottle therein. Resilient fingers help to secure the bottle within this hole in the top deck of the lower retainer. The lower retainer can be fitted with multiple holes and sized appropriately so that multiple bottles can be held by a single lower retainer. Where multiple bottles are being held, typically a flap is provided which extends inward from a side leg that supports the top deck away from the lower end wall of the outer box. This flap supports the top deck to keep it in proper position for supporting the lower ends of the bottles.

The upper retainer primarily includes a main panel with one or more holes therein to receive necks of bottles passing therethrough. This main panel is spaced from the upper end of the outer box by at least one spacing panel. This at least one spacing panel is preferably in the form of at least one panel extending between opposite walls of the outer box and perpendicular to the main panel to support the main panel spaced from the upper end wall of the outer box. Particular folding patterns and reinforcing layers are provided for the upper retainer and lower retainer so that these retainers can be formed from sheets of corrugated paperboard material or other similar material, and provide the requisite strength and shape to hold one or more bottles within the outer box in a manner preventing the bottles contained within the outer box from impacting walls of the outer box with sufficient force to break the bottles.

OBJECTS OF THE INVENTION

Accordingly, a primary object of the present invention is to provide a bottle packaging enclosure which exhibits sufficient strength and flexibility to securely and safely hold a bottle without damage within an overall package for safe shipping of the bottle.

Another object of the present invention is to provide a bottle shipping container which can satisfy shipping industry recognized drop tests.

Another object of the present invention is to provide a bottle supporting enclosure which is economically feasible to manufacture.

Another object of the present invention is to provide a bottle supporting enclosure which facilitates fast packing speeds for assembling the inner parts into the required outer box.

Another object of the present invention is to provide a bottle enclosure which can support different numbers of bottles in a flexible fashion within differently shaped outer boxes.

Another object of the present invention is to provide a bottle support enclosure which can be stored flat before use, such that inventory space for the enclosures is minimized before use.

Another object of the present invention is to provide a bottle support enclosure which resists damage to labels on the bottle.

Another object of the present invention is to provide a bottle support enclosure which can be formed from standard corrugated paperboard cutting and creasing equipment.

Another object of the present invention is to provide a bottle supporting enclosure which can be made of 100% recyclable and 100% biodegradable material.

Other further objects of the present invention will become apparent from a careful reading of the included drawing figures, the claims and detailed description of the invention.

DESCRIPTION OF THE PREFERRED EMBODIMENT

Figure 2:
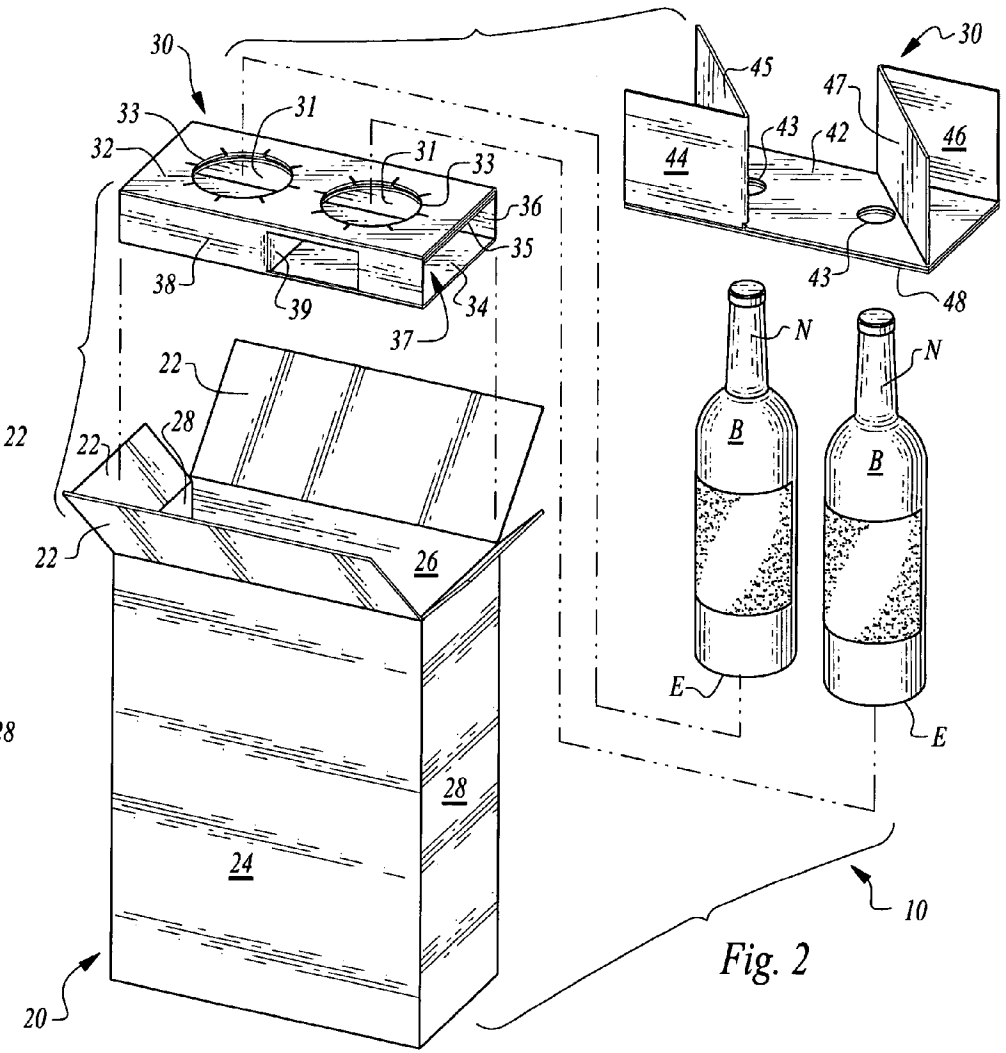
FIG. 2 is an exploded parts view of that which is shown in FIG. 1.
Figure 1:
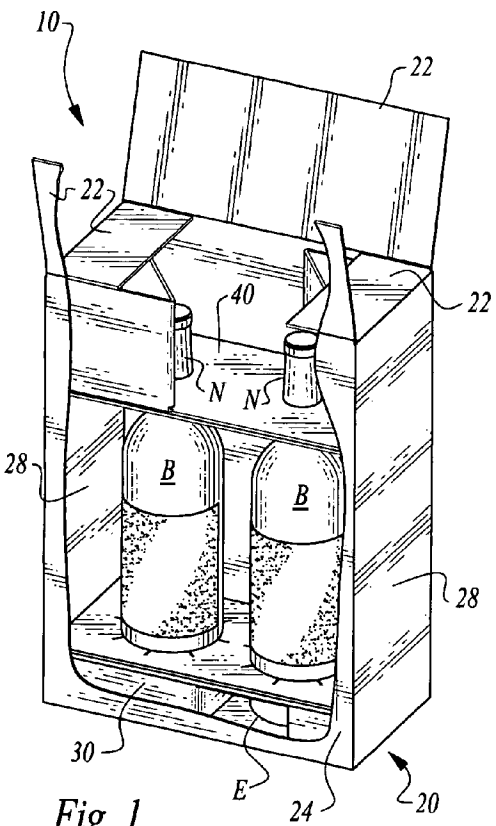
FIG. 1 is a perspective view of a double bottle enclosure illustrating the packaging of this invention and with portions of the outer box cut away to reveal interior details.
Figure 12:
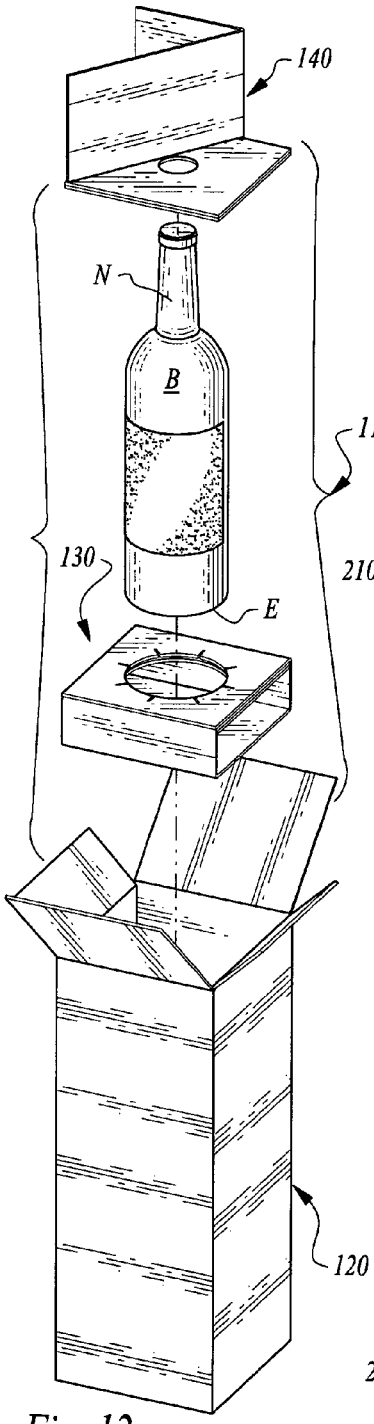
FIG. 12 is an exploded parts view of an alternative single bottle enclosure for holding a single bottle rather than two bottles as with the embodiment of FIG. 1.
Figure 13:
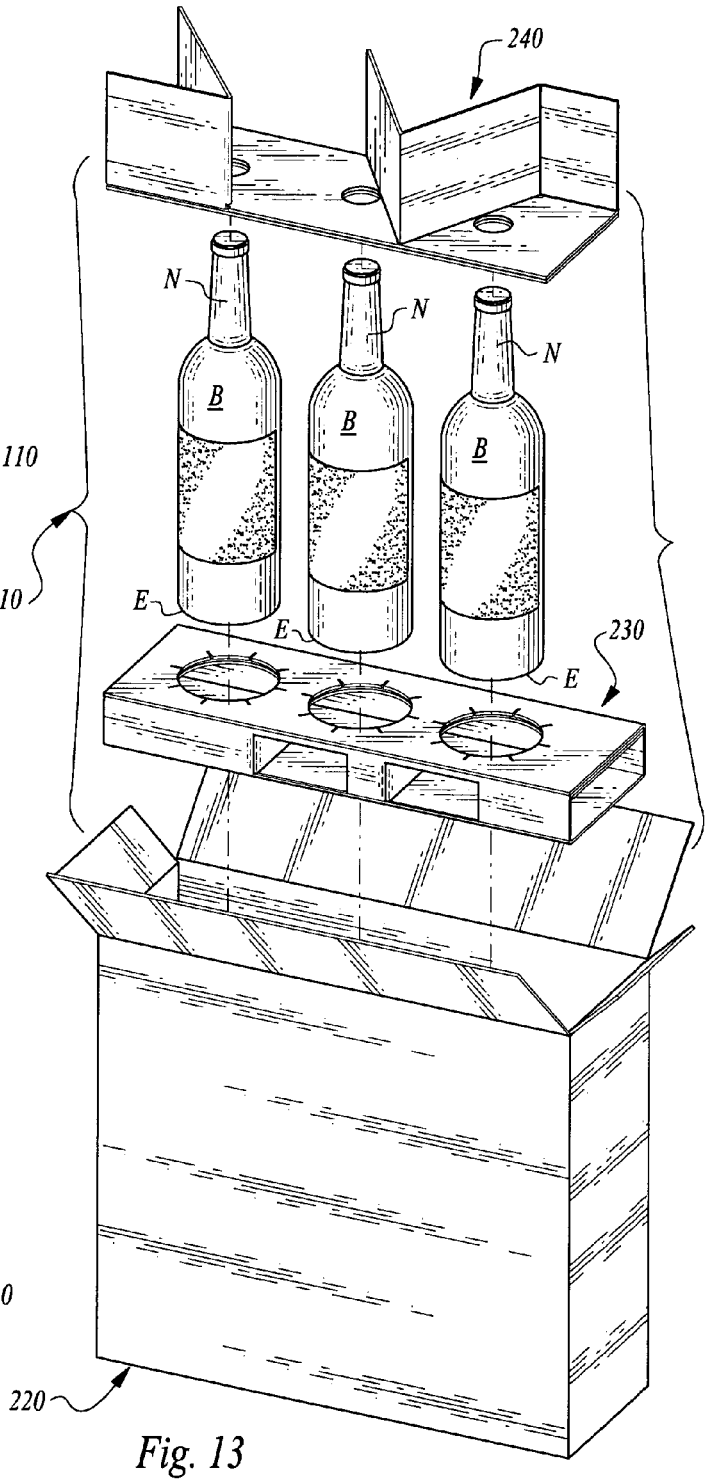
FIG. 13 is an exploded parts view illustrating a triple bottle enclosure embodiment of this invention.
Figure 14:
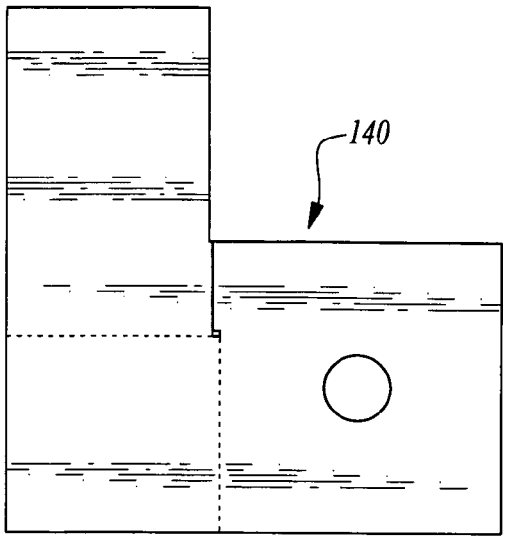
FIG. 14 is a top plan view of the single bottle upper retainer before folding to manufacture the upper retainer.
Figure 15:
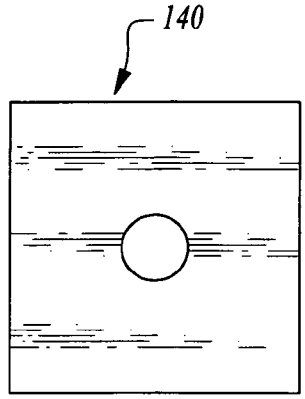
FIG. 15 is a top plan view of a reinforcing panel optionally used to strengthen the upper retainer.
Figure 16:
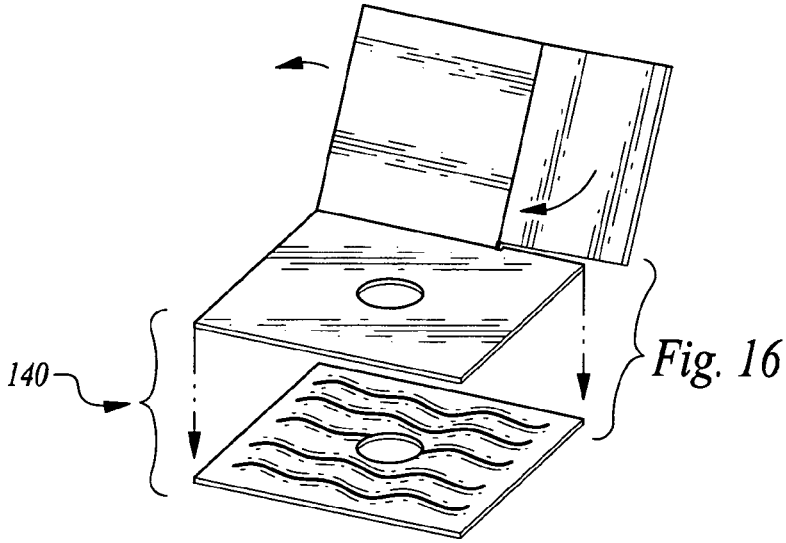
FIG. 16 is a perspective view of that which is shown in FIGS. 14 and 15 during the process of manufacturing the single bottle upper retainer.
Figure 17:
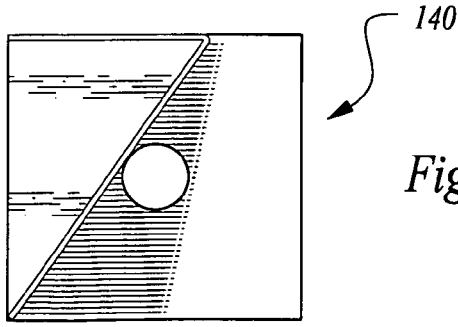
FIG. 17 is a top plan view similar to that which is shown in FIG. 16, but after completion of the upper retainer construction process.
Figure 18:
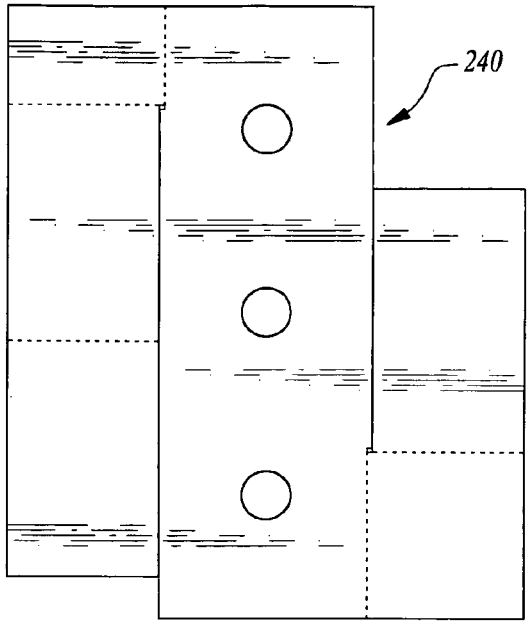
FIG. 18 is a top plan view of the upper retainer corresponding with the triple bottle enclosure before folding and other manufacture of the upper retainer of the triple bottle enclosure.
Figure 19:
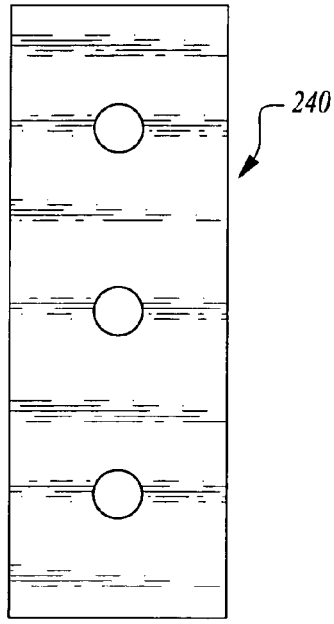
FIG. 19 is a top plan view of an optional reinforcing panel for the upper retainer.
Figure 20:
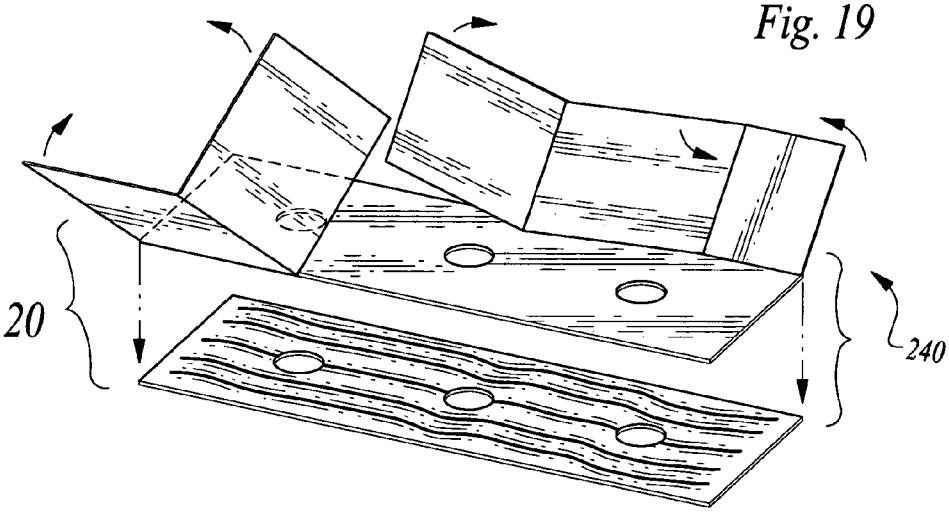
FIG. 20 is a perspective view of that which is shown in FIGS. 18 and 19 during the process of manufacturing the upper retainer for the triple bottle enclosure.
Figure 21:
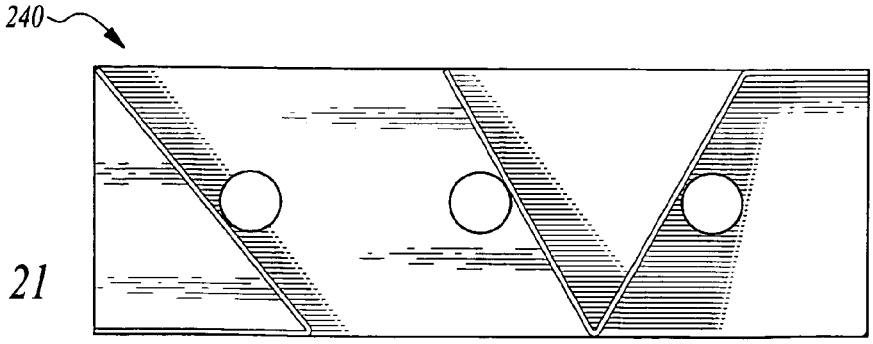
FIG. 21 is a top plan view of that which is shown in FIG. 20, but after completion of construction of the upper retainer for the triple bottle enclosure.

Referring to the drawings, wherein like reference numerals represent like parts throughout the various drawing figures, reference numeral 10 is directed to a double bottle enclosure (FIGS. 1 and 2). The double bottle enclosure 10 is configured to support a bottle B, such as a wine bottle B, and protect the bottle B from damage during shipping, storage and other handling thereof. While the double bottle enclosure 10 is disclosed in an exemplary embodiment, a single bottle enclosure 110 (FIG. 12) and a triple bottle enclosure 210 (FIG. 13) are also disclosed which are analogous to the double bottle enclosure 10, except where specifically described hereinbelow.

In essence, and with particular reference to FIGS. 1 and 2, basic elements of the double bottle enclosure 10 are described, according to a preferred embodiment. The double bottle enclosure 10 includes an outer box 20 as well as a lower retainer 30 and upper retainer 40 sized and shaped to fit snugly within the outer box 20. The outer box 20 is generally orthorhombic in shape to appear rectangular if viewed from the front, the top or the side. This outer box 20 is formed of separate walls of thin planar material such as corrugated paperboard.

The lower retainer 30 is sized to fit within a lower portion of the outer box 20. The lower retainer 30 is formed of separate planar decks/layers particularly shaped to support a lower portion of a bottle B adjacent a lower portion of the outer box 20. The lower retainer 30 holds a lower portion of the bottle B spaced from the outer box 20 to cushion the bottle B from any jolts or other loads encountered during shipping and other movement of the enclosure 10. The upper retainer 40 is sized and shaped to fit within an upper portion of the outer box 20. The upper retainer 40 is also configured from separate planar panels which are configured to support an upper portion of the bottle B and a neck N of the bottle B within the outer box 20. The upper retainer 40 is configured to keep the neck N and upper portions of the bottle B from impacting the outer box 20 when jolts or other loads are encountered.

More specifically, and with continuing reference to FIGS. 1 and 2, details of the outer box 20 are described, according to this preferred embodiment of the double bottle enclosure 10. The outer box 20 is most preferably merely in the form of a standard corrugated paperboard box. Thus, the outer box 20 includes a planar front wall 24 spaced from a planar rear wall 26. The front wall 24 and rear wall 26 are preferably of similar size and rectangular shape and are oriented parallel to each other with a distance between the front wall 24 and rear wall 26 defining a depth of the outer box 20. Side walls 28 extend from lateral sides of the front wall 24 to lateral sides of the rear wall 26. The side walls 28 are preferably perpendicular to the front wall 24 and rear wall 26. The side walls 28 are parallel to each other and a distance between the side walls 28 defines a width of the outer box 20. Both the front wall 24, rear wall 26 and side walls 28 are preferably all formed from a common sheet of corrugated paperboard material which is merely creased at edges between the front wall 24 and side walls 28 and between the rear wall 26 of the side walls 28.

Upper and lower ends of the outer box 20 are configured with flaps 22 to close off the upper and lower ends of the outer box 20. These flaps 22 generally include short flaps at upper ends of the side walls 28 which extend only a short distance toward each other. The flaps 22 also include large flaps which extend from the front wall 24 and rear wall 26 a distance similar to half of a depth of the outer box 20. Thus, when these large flaps 22 are closed into a plane perpendicular to the side walls 28 and the front and rear walls 24, 26 these large flaps 22 contact each other or come close to contacting each other at a midline of the upper and lower ends of the outer box 20, midway between the front wall 24 and rear wall 26.

With such a shape, the outer box 20 includes an interior which is slightly taller than a height of a standard bottle, such as a 750 milliliter wine bottle. Also, a width of the outer box 20 between the side walls 28 is slightly greater than two times a diameter of a wine bottle so that two wine bottles or other similarly shaped bottles B can reside adjacent to each other within the interior of the outer box 20 without contacting each other and without contacting side walls 28. A depth of the outer box 20 is preferably approximately half the width of the outer box 20 so that bottles B within the interior of the outer box 20 do not contact the front wall 24 or rear wall 26.

The outer box 20 provides a preferred form of a means to hold the lower retainer 30 and upper retainer 40 in position adjacent a lower end of the bottle B and a neck N of the bottle B. The outer box 20 thus forms an important portion of the double bottle enclosure 10 keeping the retainers 30, 40 in position so that the bottle B can be held in position within an interior of the enclosure 10. While the outer box 20 is disclosed as preferably formed of corrugated paperboard, this outer box 20 could be formed of other materials such as thin sheets of wood or plastic sheet materials or composite materials or any other generally planar substantially rigid materials.

While the outer box 20 is preferably substantially enclosed, it is conceivable that this outer box 20 could include portions thereof cut away such as to form windows in the outer box 20 either to reveal details of the bottles B or other contents within the outer box 20, or to otherwise enhance the usefulness of the outer box 20, such as to enhance a desirable appearance of the outer box 20 or to provide a location for storage of auxiliary items that might be shipped along with the bottles B or other primary contents within the double bottle enclosure 10.

Typically, outer surfaces of the outer box 20 would be printed with some form of information. This information could be quite elaborate in the form of full color printing or large labels affixed to the outer box 20. Alternatively, the outer surface could be merely printed with very basic information or fitted with a label such as a mailing address to which the package formed by the double bottle enclosure 10 is to be shipped.

With particular reference to FIGS. 3-6, details of the lower retainer 30 are described according to this preferred embodiment of the double bottle enclosure 10. The lower retainer 30 is configured to support the lower end E of the bottle B adjacent the lower end of the outer box 20. The lower retainer 30 begins as a planar sheet of material (FIGS. 3 and 4) which has been formed with holes, cuts and creases (or perforations or other zones of weakness) appropriately to allow for folding of this planar sheet of material to form the lower retainer 30. This preferred construction is well suited to formation of the lower retainer 30 out of corrugated paperboard and allows the lower retainer 30 to take up an exceptionally small amount of space before it has been constructed into the lower retainer 30.

In particular, this sheet forming the initial lower retainer 30 includes at least five separate sections including a top deck 32, a side leg 38, a bottom deck 34, another side leg 38, an under layer 35. The sheet can optionally include a mid layer 36, but the mid layer 36 is preferably provided separately and bonded or merely placed adjacent the top deck 32. These sections can be formed into the planar sheet forming the lower retainer 30. While shown as a single sheet, most preferably the mid layer 36 is a separate sheet of material so that no portions of the lower retainer 30 are required to rotate 180° relative to adjacent portions of the sheet forming the lower retainer 30.

Figure 3:
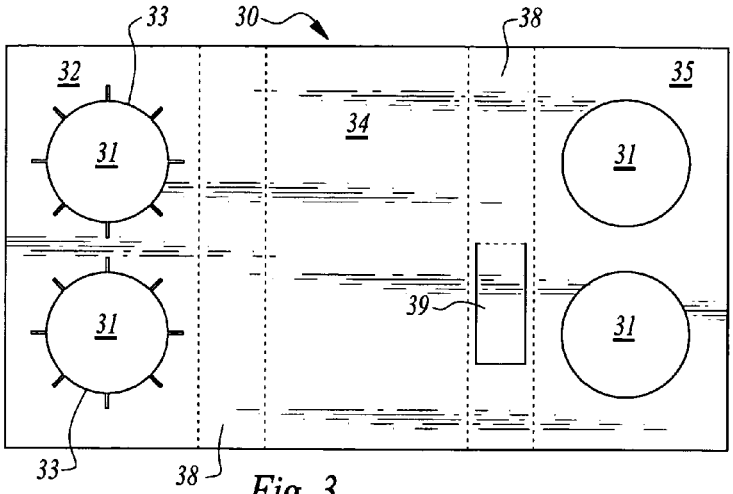
FIG. 3 is a top plan view of the lower retainer of the double bottle enclosure shown laying flat before being folded to manufacture the lower retainer.
Figure 4:
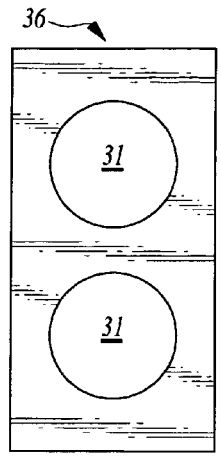
FIG. 4 is a top plan view of a mid layer optionally added to reinforce the lower retainer of FIG. 3.
Figure 5:
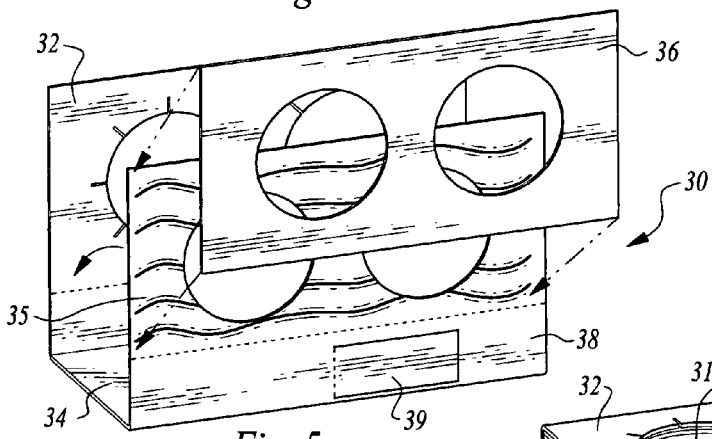
FIG. 5 is a perspective view of that which is shown in FIGS. 3 and 4 after an initial step in the process of manufacturing the lower retainer.
Figure 7:
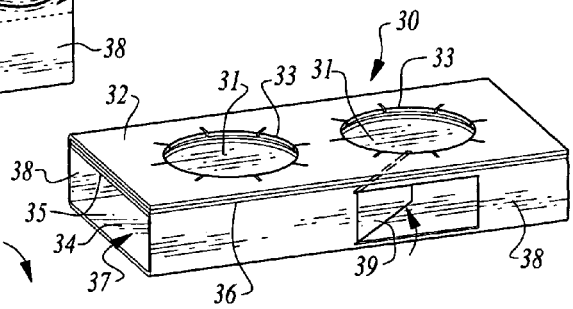
FIG. 7 is a perspective view of that which is shown in FIGS. 3 and 4 after completion of the manufacturing process to fully form the lower retainer.
Figure 6:
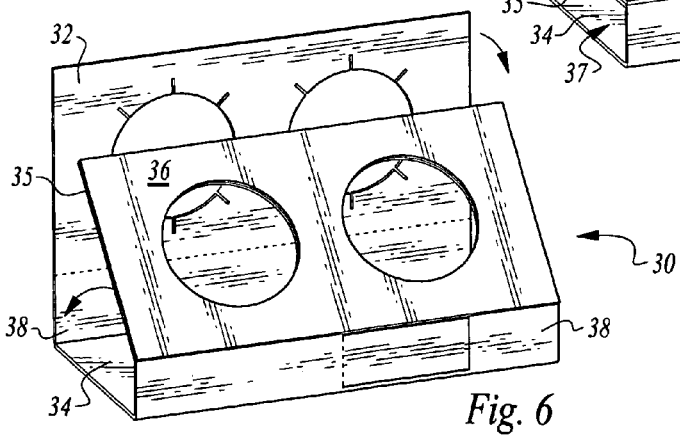
FIG. 6 is a perspective view similar to that which is shown in FIG. 5, but further along in the process of manufacturing the lower retainer.
Figure 8:
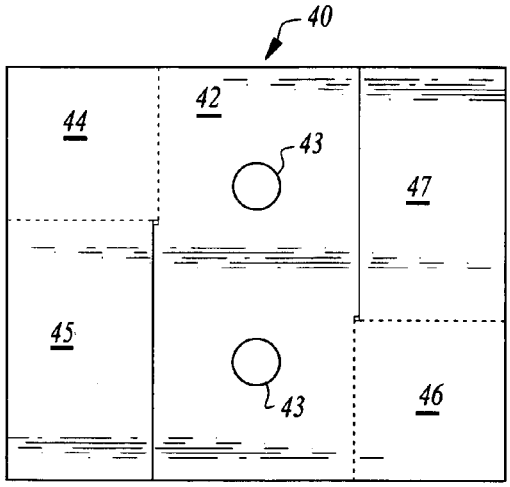
FIG. 8 is a top plan view of a portion of an upper retainer of the double bottle enclosure.

The sheet of material forming the initial lower retainer 30 is preferably rectangular in form with a width similar to the width of the outer box 20 so that portions of the lower retainer 30 fit snugly within the outer box 20. Each of the separate sections of the lower retainer 30 have depths which when added together form the overall depth of this sheet forming the lower retainer 30 (FIG. 3). This corrugated paperboard material could have fluting running in multiple different orientations to enhance strength of the lower retainer 30 or could be oriented to have strength in the direction of greatest anticipated load. At crease sections, the corrugated paperboard material can be partially crushed or perforated or otherwise weakened to facilitate bending of the lower retainer 30 at the transitions between the sections forming the lower retainer 30. These transitions are depicted by dashed lines.

The top deck 32 of the lower retainer 30 includes two generally circular holes 31 therein. These holes are strategically located and sized to allow the lower ends E of two bottles B to fit snugly within these lower holes 31. To facilitate such a snug fit, preferably the holes 31 are slightly smaller than the lower ends E of the bottles B and radial slits extend radially from the holes 31 into the top deck 32 to form a plurality of perimeter fingers 33 extending toward a center of the holes 31. These perimeter fingers 33 can flex when the lower end E of a bottle B is pushed into one of the holes 31. The perimeter fingers 33 thus flex just enough to maintain secure support of the bottle B and allow for a partial cushioning effect when jolts are applied to the double bottle enclosure 10.

The top deck 32 is maintained in position spaced above the lower end of the outer box 20 by a pair of side legs 38 extending perpendicularly down from the top deck 32. These side legs 38 are joined together by a bottom deck 34 of similar size and shape to the top deck 32. The bottom deck 34 is configured to rest directly adjacent the lower end of the outer box 20. The bottom deck 34 does not include holes therein. The lower end E of each bottle B typically abuts against the bottom deck 34 and the bottom deck 34 acts as an additional layer of cushioning merely to the extent that corrugated paperboard materials can absorb some of a compression load by crushing slightly.

The top deck 32 is reinforced by an under layer 35 oriented parallel with the top deck 32 and spaced from the bottom deck 34 by a void 37 having a height similar to that of a height of the side legs 38. The under layer 35 can be bonded directly to the top deck 32, but preferably has a mid layer 36 interposed between the under layer 35 and top deck 32. Thus, the top deck 32 is reinforced by the under layer 35 and mid layer 36 directly adjacent the top deck 32. The under layer 35 and mid layer 36 preferably include holes 31 similar to the holes 31 in the top deck 32, but without the perimeter fingers 33 and slightly larger to allow the fingers 33 to flex. Each of the holes 31 in the under layer 35, mid layer 36 and top deck 32 are aligned together so that when the lower retainer 30 is constructed, essentially a pair of holes are presented for supporting the lower ends E of the two bottles B within the outer box 20 of the enclosure 10.

To further reinforce the top deck 32 and keep the top deck 32 from being crushed downward toward the bottom deck 34, a flap 39 is preferably formed in at least one of the side legs 38.

This flap 39 is cut out and pivoted away from the side leg 38 somewhat so that it acts as a spacer to maintain space between the bottom deck 34 and top deck 32. This flap 39 is positioned so that it supports the top deck 32 at a midpoint between the two holes 31 in the top deck 32. If desired, multiple flaps 39 can be provided, such as in each of the side legs 38 extending away from the front and rear of the outer box 20.

Figure 9:
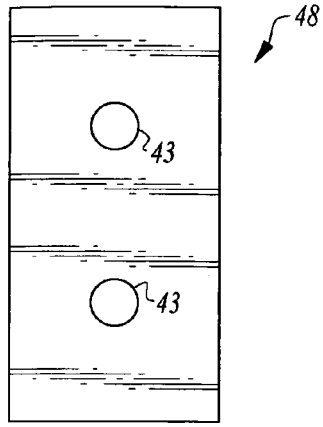
FIG. 9 is a top plan view of a reinforcing panel for optional use with the upper retainer to further strengthen the upper retainer of FIG. 8.
Figure 10:
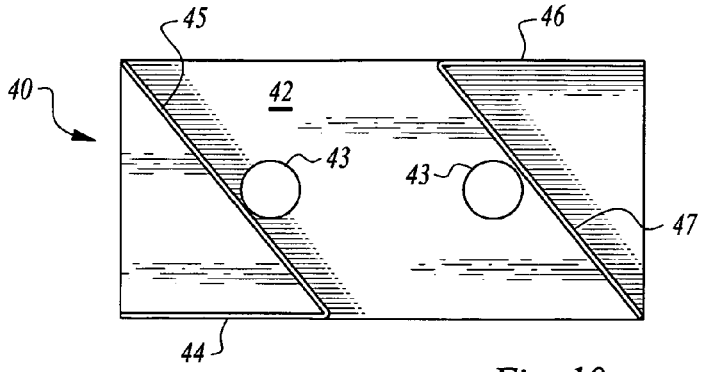
FIG. 10 is a top plan view of the upper retainer after complete manufacture thereof.
Figure 11:
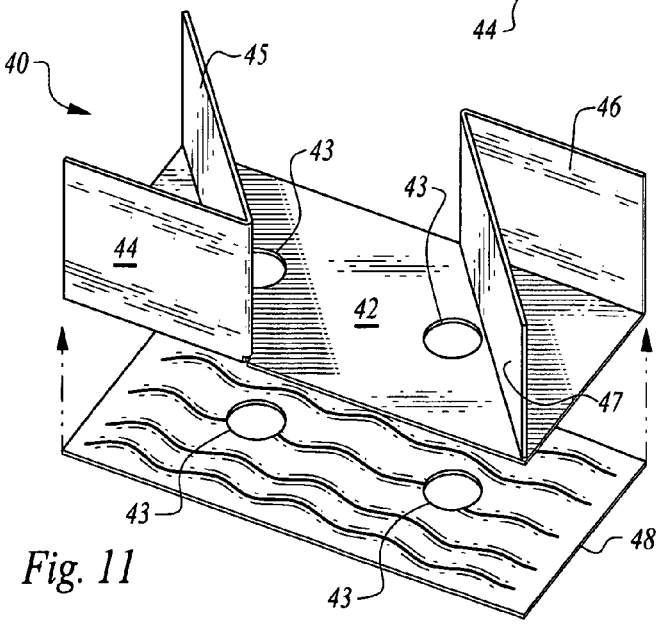
FIG. 11 is a perspective view of that which is shown in FIG. 9 showing the addition of the reinforcing panel with adhesive.

With particular reference to FIGS. 8-11, details of the upper retainer 40 are described, according to this preferred embodiment of the double bottle enclosure 10. The upper retainer 40 is also formed preferably from a planar sheet of rigid material such as corrugated paperboard to support the neck N and other upper portions of the bottle B, and a pair of bottles B in this double bottle enclosure 10 embodiment. The upper retainer 40 (FIGS. 8 and 9) is most preferably formed with at least a portion thereof provided as a separate section (FIG. 9). The sections of the upper retainer include a main panel 42, a front panel 44, a first diagonal panel 45, a rear panel 46 and a second diagonal panel 47. The main panel 42 includes holes 43 therein which are just large enough to allow necks N of each bottle B to pass therethrough. While different bottles B can have different neck N sizes, neck N sizes are typically sufficiently similar to each other on bottles B of different designs to allow the upper retainer 40 to work with multiple different bottles without modification. Furthermore, with only minor modification to the height of the front panel 44, rear panel 46, diagonal panels 45, 47 and bottles B having different neck N configurations can also be accommodated.

The main panel 42 has a width and a depth which causes it to fit snugly within the outer box 20 in a horizontal orientation extending between the side walls 28 and between the front wall 24 and rear wall 26 perpendicular to each of these walls 24, 26, 28. This main panel 42 is spaced from the upper end of the outer box 20 by a height of the front panel 44, rear panel 46 and diagonal panels 45, 47. These panels thus act as a preferred form of spacer panel to space the main panel 42 from the upper end of the outer box 20 as desired. The holes 43 in the main panel 42 are sized to cause the bottle B to be flaring to a larger diameter adjacent where the holes 43 are located, so that the bottle B cannot move vertically up through the holes 43 when the main panel 42 having the holes 43 therein is spaced from the upper end of the outer box 20 by a distance defined by the height of the front and rear panels 44, 46 and the diagonal panels 45, 47.

The front panel 44 and rear panel 46 preferably bend perpendicularly from the main panel 42 a similar distance defining a height of the upper retainer 40 and a distance of the main panel 42 away from the upper end of the outer box 20. Ends of the front panel 44 and rear panel 46 most distant from the side walls 28 of the outer box 20 have diagonal panels 45, 47 pivotably attached thereto. These diagonal panels 45, 47 preferably are rotated greater than 90° away from the front panel 44 and rear panel 46. They rotate past the holes 43 and resist returning to a coplanar orientation with the front panel 44 and rear panel 46 by placement of the bottles B passing through the holes 43. These diagonal panels 45, 47 are held in place adjacent the necks N of the bottles B so that the diagonal panels 45, 47 are on edge and providing rigid support for the main panel 42 and the entire upper retainer 40 directly adjacent the necks N of the bottles B to provide maximum strength adjacent where it is needed to protect the necks N of the bottles B within the double bottle enclosure 10.

The diagonal panels 45, 47 preferably have a length extending away from the front panel 44 or rear panel 46 which is greater than a depth of the outer box 20 between the front wall 24 and rear wall 26. In this way, when the front panel 44 is adjacent the front wall 24, and the first diagonal panel 45 is extending away from the front panel 44, the first diagonal panel 45 extends an entire depth of the outer box 20 and into contact with the rear wall 26 with the end of the first diagonal panel 45 most distant from the front panel 44 closer to the side wall 28 adjacent the front panel 44 than is the end of the first diagonal panel 45 that is attached to the front panel 44. Similarly, the second diagonal panel 47 extends from the rear panel 46 with the rear panel 46 adjacent the rear wall 26 and with the second diagonal panel 47 extending to the front wall 24. While this configuration for the diagonal panels 45, 47 that is described above and shown as preferred, the diagonal panels 45, 47 could be routed in other ways, such as generally parallel with each other between the two holes 43, optionally with some form of spacer between the two diagonal panels 45, 47 to keep them adjacent the necks N of the bottles B.

Most preferably, at least one reinforcing panel 48 is provided adjacent the main panel 42 which has a shape and size similar to the main panel 42 and with holes 43 aligned with the holes 43 in the main panel 42. The reinforcing panel 48 further enhances a stiffness of the main panel 42 for the upper retainer 40.

While the front panel 44, rear panel 46 and first and second diagonal panels 45, 47 are described in this preferred embodiment, other forms of spacing panels could be utilized to provide the basic function of maintaining the main panel 42 spaced from the upper end of the outer box 20 and to keep the main panel 42 in a substantially perpendicular orientation relative to the front wall 24, rear wall 26 and side walls 28. Such spacing panels could be formed as a separate structure from the main panel 42 and either fit snugly adjacent the main panel 42 or be glued to the main panel 42, or could be folded from an initial single piece of planar material as described above, but with different configurations to provide such a spacing panel.

To accommodate bottles B of different sizes and shapes, the upper retainer 40 could be modified or spacer sections could be provided which could be utilized in conjunction with the upper retainer 40 to space the upper retainer 40 slightly further away from the upper end of the outer box 20 to keep the upper retainer 40 snugly against the neck N of the bottle B to hold the bottles B securely within the double bottle enclosure 10 without the bottles B coming into contact with the outer box 20.

With particular reference to FIGS. 12-21, details of alternative enclosures are described which can accommodate a greater or lesser number of bottles B than the double bottle enclosure 10 described in detail above. In FIGS. 12 and 14-17 a single bottle enclosure 110 is shown. The single bottle enclosure 110 includes an outer box 120 which preferably has a square horizontal cross-section and a rectangular front and rectangular side cross-section. A lower retainer 130 is provided similar to the lower retainer 30 of the double bottle enclosure 10 except cut in half so that it only has one hole to support a lower end E of a single bottle B therein. The upper retainer 140 of the single bottle enclosure 110 is preferably configured similar to the upper retainer 40 of the double bottle enclosure 10, except that the upper retainer 140 includes only one diagonal panel and one front or rear panel from which the diagonal panel pivots. FIGS. 14-17 illustrate the configuration of the upper retainer 140 when originally provided as a flat sheet of corrugated paperboard or similar material and the steps involved in folding and bending different portions of the upper retainer 140 to construct the upper retainer 140 for supporting the neck N of a bottle B within the outer box 120.

While the lower retainer 130 and upper retainer 140 are particularly configured to support a single bottle B within the outer box 120 as part of the single bottle enclosure 110, the lower retainer 130 and upper retainer 140 can also be provided in pairs to fit within the outer box 20 of the double bottle enclosure 10 in a side by side fashion. Furthermore, three sets of lower retainers 130 and upper retainers 140 can be provided adjacent each other to fit within a triple bottle enclosure 210 (FIG. 12) to support three bottles B thereinto. Thus, the lower retainer 130 and upper retainer 140 act as a form of least common denominator for supporting a single bottle B which can be either utilized alone within the outer box 120 or in pairs within the outer box 20, or in groups of three within the triple bottle enclosure 210, or in combination with the lower retainer 30 and upper retainer 40 of the double bottle enclosure 10 to fit within a triple bottle enclosure 210.

It is also conceivable that a larger outer box 120 could be provided which has twice the depth and twice the width of the outer box 120 and four such lower retainers 130 and upper retainers 140 could be configured together to support four bottles B within such a larger outer box to form a four bottle enclosure. Such a four bottle enclosure could also be utilized with a pair of lower retainers 30 and a pair of upper retainers 40 to support four bottles B within such a double width and double depth outer box.

With particular reference to FIGS. 13 and 18-21, details of the triple bottle enclosure 210 defining another alternative embodiment of this invention are described. The triple bottle enclosure 210 includes an outer box 220 and lower retainer 230 and upper retainer 240 each particularly configured to support three bottles B within the triple bottle enclosure 210. The outer box 220 preferably has a depth similar to that of the single bottle enclosure 110 and double bottle enclosure 10, but a width between side walls which is three times as great as a width of the outer box 120 and fifty percent greater than the width of the outer box 20. The lower retainer 230 is preferably similar to the lower retainer 30 and lower retainer 130 of previously described embodiments except that three holes are provided in the top deck spaced equally from each other to each support a separate bottle B so that three bottles can be supported within the lower retainer 230. If flaps are provided to support the top deck, preferably two such flaps would be provided in one of the side legs to support the top deck at mid locations between the holes in the top deck.

The upper retainer 240 is analogous to the upper retainer 140 and upper retainer 40 of previously described embodiments. Thus, a front panel is provided that bends upwardly from a horizontal main panel having three holes therein to support three bottles B. A diagonal panel extends from this front panel similar to the diagonal panel of the upper retainer 140 associated with the single bottle enclosure 110. Uniquely, the rear panel of the upper retainer 240 has an accordion diagonal panel coupled thereto which has two separate diagonal portions including a first portion closest to the rear panel and a second portion extending from the first portion. These two portions form a V-shape between two of the three holes in the main panel most distant from the front panel. With such a V-shape, these portions of the two diagonal panels abut against necks N of bottles B passing through the holes in the main deck to provide support directly adjacent the necks N of the bottles B. These diagonal portions are each longer than a depth of the outer box 220 so that they span a depth of the outer box 220 and extend diagonally between front and rear walls of the outer box 220.

The lower retainer 230 and upper retainer 240 fit snugly within the outer box 220 to support three bottles B within the outer box 220. Alternatively, the outer box 220 can be utilized supporting three lower retainers 130 and three upper retainers 140 or one lower retainer 130 and one lower retainer 30 as well as one upper retainer 140 and one upper retainer 40 to support three bottles B within the outer box 220. Also, it is conceivable that an outer box could be configured which has twice the depth of the outer box 220. Such a double depth outer box could support two lower retainers 230 and two upper retainers 240 and support six bottles B therein.

Such a six bottle B outer box 220 could also support six bottles B with other combinations of retainers from the triple bottle enclosure 210 embodiment, the single bottle enclosure 110 embodiment and the double bottle enclosure 10 embodiment. For instance, such a six bottle B outer box 220 could be fitted with three pairs of retainers 30, 40 from the double bottle enclosure 10 in a variety of different configurations. Such a six bottle B outer box could also be fitted with six retainers 130, 140 from the single bottle enclosure 110 embodiment. Such a six bottle B outer box could also be fitted with one pair of retainers 230, 240 from the triple bottle enclosure 210 embodiment and three sets of retainers 130, 140 from the single bottle enclosure 110 embodiment. From this disclosure one skilled in the art can also readily determine that even larger outer boxes could be provided and fitted with various different types and numbers of retainers supporting various different numbers of bottles B.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. An enclosure for containing at least one bottle therein, the enclosure comprising in combination:

an outer box substantially completely enclosing an interior space;

said outer box having an orthorhombic shape including a substantially planar front wall opposite a substantially planar rear wall, with side walls extending between said front wall and said rear wall, and with upper and lower end walls adapted to enclose upper and lower ends of said box;

a lower retainer adapted to reside within said interior space adjacent said lower end wall;

said lower retainer having a top deck held by said lower retainer in a position spaced from said lower end;

said top deck including at least one hole therein, said hole adapted to receive a bottle having a similar diameter to said at least one hole;

an upper retainer adapted to reside within said interior space adjacent said upper end wall;

said upper retainer having a main panel held by said upper retainer in a position spaced from said upper wall;

said main panel having at least one hole therein, said hole adapted to receive a neck of the bottle passing therethrough;

said upper retainer including at least one spacing panel abutting said main panel, said at least one spacing panel adapted to space said main panel sufficiently from said outer box to keep an upper end of the bottle out of contact with said outer box, said at least one spacing panel abutting said main panel at a point on said main panel closer to said hole in said main panel than to edges of said main panel; and said at least one spacing panel connected on at least a portion thereof to a front panel which is connected in fixed position to at least a portion of said main panel, said front panel extending from said main panel non-parallel with said main panel, and said at least one spacing panel oriented non-parallel with both said main panel and said front panel, and said at least one spacing panel oriented non-perpendicular to said front panel, such that said at least one spacing panel is to some extent held in position relative to said main panel by said front panel therebetween.

2. The enclosure of claim 1 wherein multiple holes are provided in said top deck and said main panel, such that a plurality of bottles can be supported within said outer box with each of the bottles supported by both said lower retainer and said upper retainer.

3. The enclosure of claim 2 wherein said multiple holes in said top deck and said main panel are each aligned vertically and spaced from walls of said outer box to position bottles spaced from said walls of said box when the bottles are located passing through said holes.

4. The enclosure of claim 1 wherein said top deck of said lower retainer includes a pair of side legs extending down from said top deck, said side legs adapted to space said top deck away from said lower end of said outer box.

5. The enclosure of claim 4 wherein at least one of said side legs includes a flap therein bent away from a plane in which other portions of said side leg is oriented, said flap adapted to further support said top deck spaced from said lower end wall of said outer box.

6. The enclosure of claim 4 wherein said lower retainer includes a bottom deck parallel with said top deck and spaced from said top deck by a height of said side legs, said bottom deck adapted to be located abutting said lower end of said outer box.

7. The enclosure of claim 6 wherein said lower retainer includes an under layer oriented parallel with said top deck and closer to said top deck than to said bottom deck, said under layer coupled to said top deck, said under layer having a hole therein aligned with said hole in said top deck and sized similar to said hole in said top deck.

8. The enclosure of claim 7 wherein a mid layer is oriented adjacent said under layer and said top deck, said mid layer having a hole therein similar to said hole in said under layer and said hole in said top deck.

9. The enclosure of claim 1 wherein said top deck has a width and a depth similar to a distance between said side walls and said rear wall and said front wall, such that said top deck is prevented from substantial lateral movement by said outer box.

10. The enclosure of claim 9 wherein said hole in said top deck includes a plurality of fingers radiating toward a center of said hole, said fingers having an inside edge defining a circle having a diameter less than the diameter of the bottle adapted to be enclosed within said enclosure, said fingers adapted to flex sufficiently to allow the bottle to pass into the hole with said fingers engaging the bottle.

11. The enclosure of claim 1 wherein said upper retainer includes at least one panel perpendicular to said main panel, said at least one panel extending up from said main panel to said upper end wall of said outer box.

12. The enclosure of claim 11 wherein said at least one panel of said upper retainer includes both a front panel and a diagonal panel, said front panel and said diagonal panel each oriented perpendicular to said main panel, said front panel adapted to be located adjacent said front wall of said outer box and said diagonal panel extending rearwardly from said front panel, said diagonal panel coupled to said front panel.

13. The enclosure of claim 12 wherein a reinforcing panel is located adjacent said main panel, said reinforcing panel bonded to said main panel, said reinforcing panel having a hole therein aligned with said hole in said main panel.

14. The enclosure of claim 13 wherein said diagonal panel has a length greater than a depth of said outer box, said diagonal panel bent away from said front panel an amount greater than 90°, with said diagonal panel having sufficient resiliency to be biased toward returning toward a planar orientation along with said front panel, said length of said diagonal panel sufficient to keep said diagonal panel oriented away from planar with said front panel due to said length of said diagonal panel being greater than a depth of said outer box.

15. The enclosure of claim 1 wherein multiple holes are provided in said top deck and said main panel, such that a plurality of bottles can be supported within said outer box with each of the bottles supported by both said lower retainer and said upper retainer; and said at least one spacing panel abuts said main panel adjacent each of said multiple holes in said main panel.

16. A bottle enclosure comprising in combination:

an outer box formed of a plurality of thin planar walls;

a lower retainer;

said lower retainer adapted to fit within said outer box;

said lower retainer adapted to support a lower end of a bottle adjacent thereto;

an upper retainer;

said upper retainer adapted to fit within said outer box;

said upper retainer adapted to support a neck of a bottle adjacent thereto;

said upper retainer having a substantially planar main panel with a hole sized to receive the neck of the bottle passing therethrough;

said upper retainer including at least one spacing panel abutting said main panel, said at least one spacing panel adapted to space said main panel sufficiently from said outer box to keep an upper end of the bottle out of contact with said outer box, said at least one spacing panel abutting said main panel at a point on said main panel closer to said hole in said main panel than to edges of said main panel; and said at least one spacing panel connected on at least a portion thereof to a front panel which is connected in fixed position to at least a portion of said main panel, said front panel extending from said main panel non-parallel with said main panel, and said at least one spacing panel oriented non-parallel with both said main panel and said front panel, and said at least one spacing panel oriented non-perpendicular to said front panel, such that said at least one spacing panel is to some extent held in position relative to said main panel by said front panel therebetween.

17. The bottle enclosure of claim 16 wherein said at least one spacing panel includes a diagonal panel oriented perpendicular to said main panel and extending between opposing thin planar walls of said outer box in a direction neither parallel nor perpendicular relative to said walls of said outer box.

18. The bottle enclosure of claim 17 wherein said upper retainer includes said front panel extending upward from said main panel, said diagonal panel coupled to said front panel at one end thereof, with said diagonal panel extending away from said front panel in a direction neither parallel nor perpendicular from said front panel.

19. The bottle enclosure of claim 18 wherein said main panel includes at least two holes passing therethrough, said upper retainer including at least two diagonal panels oriented perpendicular to said main panel, said upper retainer adapted to hold two bottles with necks thereof passing through said at least two holes.

20. The bottle enclosure of claim 16 wherein said lower retainer includes a top deck, said top deck adapted to be spaced from portions of said outer box by side legs, said side legs extending substantially perpendicularly from said top deck, said top deck including a hole therein adapted to receive a portion of the bottle passing therethrough.

21. The bottle enclosure of claim 20 wherein said lower retainer includes an under layer coupled to said top deck, said under layer including a hole therein aligned with said hole in said top deck, said lower retainer adapted to be folded to align said under layer with said top deck.

22. The bottle enclosure of claim 21 wherein at least one of said side legs includes a flap formed therein, said flap adapted to be flexed away from adjacent portions of said side leg to a position underlying said main panel and substantially perpendicular to said main panel and non-parallel with said side legs.

23. The bottle enclosure of claim 16 wherein multiple holes are provided in said top deck and said main panel, such that a plurality of bottles can be supported within said outer box with each of the bottles supported by both said lower retainer and said upper retainer; and said at least one spacing panel abuts said main panel adjacent each of said multiple holes in said main panel.

24. A bottle protective enclosure comprising in combination:

an outer box formed of a plurality of thin planar walls spaced from each other and surrounding an interior space;

a first retainer;

said first retainer adapted to fit within said outer box;

said first retainer adapted to support a lower end of a bottle adjacent thereto;

a second retainer;

said second retainer adapted to fit within said outer box;

said second retainer adapted to support a neck of a bottle adjacent thereto;

said second retainer having a substantially planar main panel with a hole sized large enough to receive the neck of the bottle passing therethrough and small enough to prevent passage of the lower end of the bottle therethrough;

said second retainer including at least one spacing panel abutting said main panel, said at least one spacing panel adapted to space said main panel sufficiently from said outer box to keep an upper end of the bottle out of contact with said outer box, said at least one spacing panel abutting said main panel at a point on said main panel closer to said hole in said main panel than to edges of said main panel; and said at least one spacing panel connected on at least a portion thereof to a front panel which is connected in fixed position to at least a portion of said main panel, said front panel extending from said main panel non-parallel with said main panel, and said at least one spacing panel oriented non-parallel with both said main panel and said front panel, and said at least one spacing panel oriented non-perpendicular to said front panel, such that said at least one spacing panel is to some extent held in position relative to said main panel by said front panel therebetween.

25. The enclosure of claim 24 wherein said at least one spacing panel is located on a side of said main panel adapted to be closest to the upper end of the bottle when the upper neck of the bottle is oriented within said hole in said main panel, at least one said spacing panel sized to extend further from said main panel than a portion of the bottle adjacent the upper end of the bottle extending beyond said hole in said main panel, such that said at least one spacing panel keeps the upper end of the bottle out of contact with said outer box when said outer box is adjacent an end of said at least one spacing panel opposite said main panel.

26. The enclosure of claim 25 wherein said at least one spacing panel includes a diagonal panel oriented perpendicular to said main panel and extending away from said main panel to one of said walls of said outer box, with said diagonal panel oriented in a plane non-parallel with each of said walls of said outer box.

27. The enclosure of claim 24 wherein said first retainer includes an arcuate edge adapted to support at least a portion of the lower end of the bottle.

28. The enclosure of claim 27 wherein said arcuate edge has a diameter adapted to match a diameter of the bottle below the neck of the bottle and with the arcuate edge oriented in a plane substantially perpendicular to a long axis of the bottle.

29. The enclosure of claim 24 wherein said first retainer includes an arcuate edge adapted to support a portion of the lower end of the bottle, with said arcuate edge including at least one finger adapted to flex out of a plane in which remaining portions of said arcuate edge are oriented, with a tip of said finger adapted to be in contact with a surface of the bottle.

30. The enclosure of claim 24 wherein said second retainer includes a reinforcing panel located adjacent said main panel and extending parallel with said main panel, said reinforcing panel having a hole therein aligned with said hole in said main panel.

31. The bottle protective enclosure of claim 24 wherein multiple holes are provided in said top deck and said main panel, such that a plurality of bottles can be supported within said outer box with each of the bottles supported by both said lower retainer and said upper retainer; and said at least one spacing panel abuts said main panel adjacent each of said multiple holes in said main panel.

* * * * *